United States Patent [19]

Tsumura et al.

[11] 4,381,077

[45] Apr. 26, 1983

[54] DIESEL FUEL INJECTION NOZZLE

[75] Inventors: Yuzo Tsumura; Masatoshi Iwata, both of Oyama, Japan

[73] Assignee: Kabushiki Kaisha Komatsu Seisakusho, Tokyo, Japan

[21] Appl. No.: 270,539

[22] Filed: Jun. 4, 1981

[30] Foreign Application Priority Data

Jun. 12, 1980 [JP] Japan ..... 55-80983[U]

[51] Int. Cl.[3] ..... F02M 61/08

[52] U.S. Cl. ..... 239/89; 123/531; 239/91; 239/409

[58] Field of Search ..... 239/87–89, 239/91,93–95, 407–411; 123/531, 532 X, 294

[56] References Cited

U.S. PATENT DOCUMENTS

| | | | |
|---|---|---|---|
| 894,978 | 8/1908 | Peache | 239/88 |
| 1,411,108 | 3/1922 | Kastler | 239/408 X |
| 1,798,349 | 3/1931 | Okochi | 239/93 |

*Primary Examiner*—Andres Kashnikow
*Attorney, Agent, or Firm*—Armstrong, Nikaido, Marmelstein & Kubovcik

[57] ABSTRACT

For the injection of premixed fuel and air into a diesel engine cylinder, a nozzle assembly has a piston reciprocably mounted in a nozzle body to define a premixing chamber therein. Fuel and air are delivered into this premixing chamber through respective ports which are simultaneously covered and uncovered by the piston. Extending through the premixing chamber, a stepped plunger has one end slidably fitted in a bore in the piston to define a pressure chamber therein for exerting a decreasing air pressure on the plunger and has the other end arranged for movement out of and back into the nozzle body for spraying the fuel-air mixture from the premixing chamber through spray holes formed therein. During the stroke of the piston to compress the fuel-air mixture trapped in the premixing chamber, the compressed mixture acts on the step of the plunger to hold same retracted in the nozzle body against the decreasing air pressure in the pressure chamber. Only upon movement of the piston into positive engagement with the plunger does its spray hole end project out of the nozzle body for spraying the compressed fuel-air mixture into the diesel engine cylinder.

5 Claims, 2 Drawing Figures

DIESEL FUEL INJECTION NOZZLE

BACKGROUND OF THE INVENTION

This invention pertains to a diesel fuel injection nozzle assembly for atomizing and spraying each charge of fuel, premixed with air, into the combustion chamber of a diesel engine cylinder.

Some early diesel engines employed an air-injection system, such that the fuel was atomized into the cylinder under air pressure. Although the system is known to have provided excellent smoke-free combustion, it required expensive and bulky multistage compressors and intercoolers for injection air. Consequently, with the advent of spray nozzles capable of sufficiently atomizing the fuel by use of fuel pressure alone, the solid or airless injection superseded the air-injection system with its bulky air supply equipment and has ever since become the generally accepted method of fuel injection in compression-ignition engines.

Recently, however, it is being contemplated to inject fuel into diesel engine cylinders at pressures in the order of 1000 kgf/cm$^2$, with a view to higher engine efficiency and less exhaustion of air pollutants. The usual airless injection method does not necessarily provide good combustion at such ultrahigh pressures.

SUMMARY OF THE INVENTION

The present invention seeks to renovate the air injection of fuel into diesel engine cylinders by eliminating the noted drawback that was conventionally attendant thereon. More specifically the invention aims at the provision of an improved diesel fuel injection nozzle assembly capable of finely atomizing and vaporizing the fuel and intimately premixing it with air to provide optimum combustion in engine cylinders, without the need for expensive and bulky means for air supply. The invention also seeks to keep the size of the improved injection nozzle assembly at a minimum.

Stated in brief, the nozzle assembly according to this invention includes a piston reciprocably mounted in a nozzle body to define a premixing chamber therein. The premixing chamber has a fuel inlet port and an air inlet port, for the admission of fuel and air from their low pressure supply sources, which are covered and uncovered by the piston. Also mounted in the nozzle body is a reciprocating plunger having a spray hole formed in one end which is movable out of the nozzle body for spraying the compressed fuel-air mixture from the premixing chamber into a diesel engine cylinder, and back into the nozzle body for closing the premixing chamber. The plunger is operatively associated with the piston in such a way that only toward the end of the compression stroke of the piston in the premixing chamber is the plunger shifted to have its end projected out of the nozzle body for injecting the compressed fuel-air mixture into the engine cylinder.

In a preferred embodiment the plunger has its end, opposite to the spray hole end, slidably fitted in a bore in the piston to define a pressure chamber for the exertion of an air pressure on the plunger in a direction to cause its projection out of the nozzle body. During the compression stroke of the piston the fuel-air mixture undergoing compression in the premixing chamber acts on a step of the plunger to hold same retracted in the nozzle body against the air pressure in the pressure chamber, until the piston moves into positive engagement with the plunger. Thereafter the plunger travels simultaneously with the piston and has its spray hole end moved out of the nozzle body at the end of the compression stroke of the piston.

The improved nozzle assembly of this invention uses air under low or even atmospheric pressure, demanding a higher compression ratio and therefore a long stroke of the piston. However, since the plunger remains stationary until toward the end of the compression stroke of the piston, the long stroke of the piston does not make the complete assembly inconveniently bulky. It will also be appreciated that the fuel can be thoroughly atomized and vaporized and intimately mixed with the air during the compression stroke of the piston, thus making itself ready for complete combustion in the diesel engine cylinder.

The above and other objects, features and advantages of this invention and the manner of attaining them will become more apparent, and the invention itself will best be understood, from a study of the following description of a preferred embodiment taken in connection with the attached drawings.

DESCRIPTION OF THE PREFERRED EMBODIMENT

Figure 1:
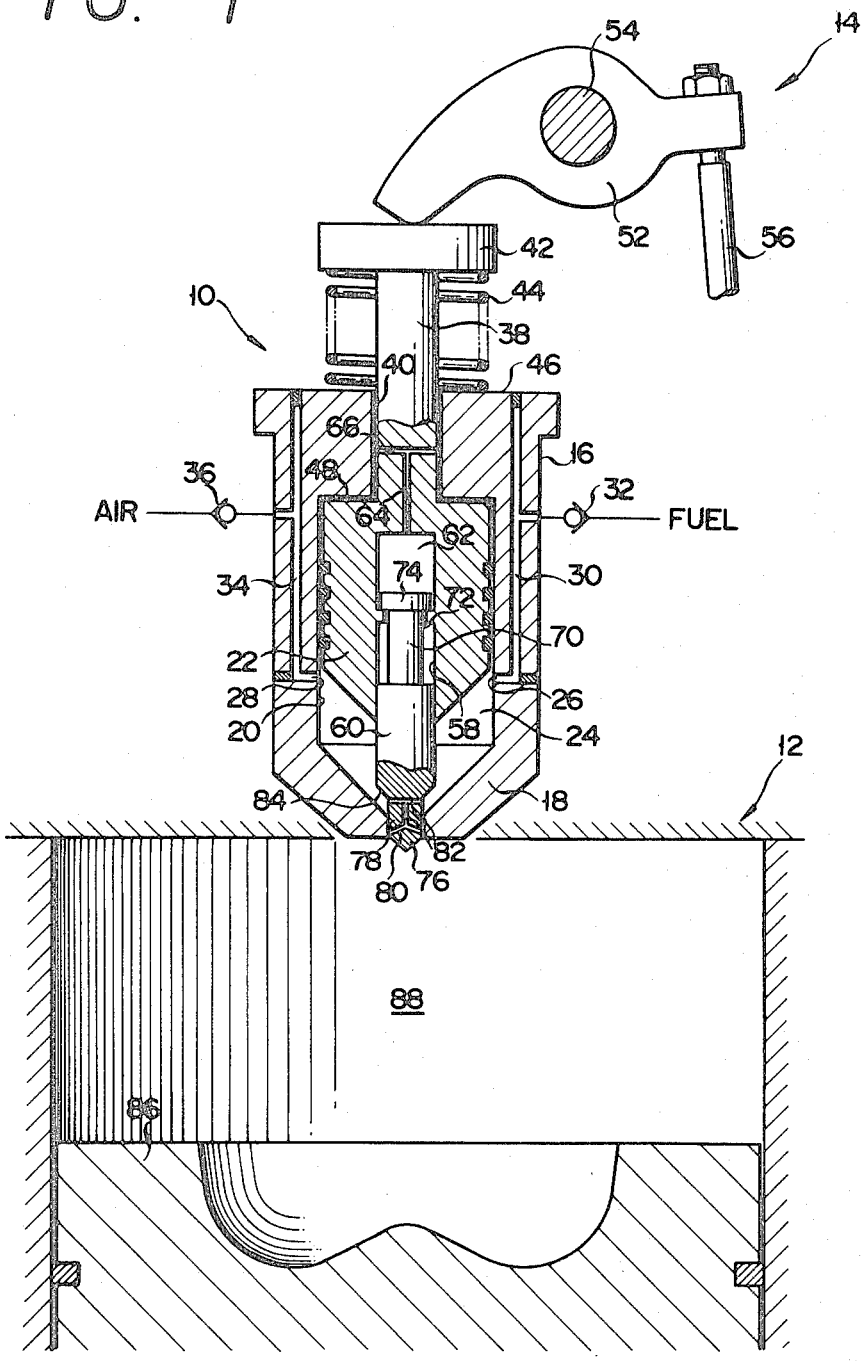
FIG. 1 is an axial sectional view of the diesel fuel injection nozzle assembly constructed in accordance with the present invention, together with a diesel engine cylinder and an actuating mechanism intended for use therewith, the nozzle assembly being shown in a state wherein the piston is raised for the admission of fuel and air into the premixing chamber.
Figure 2:
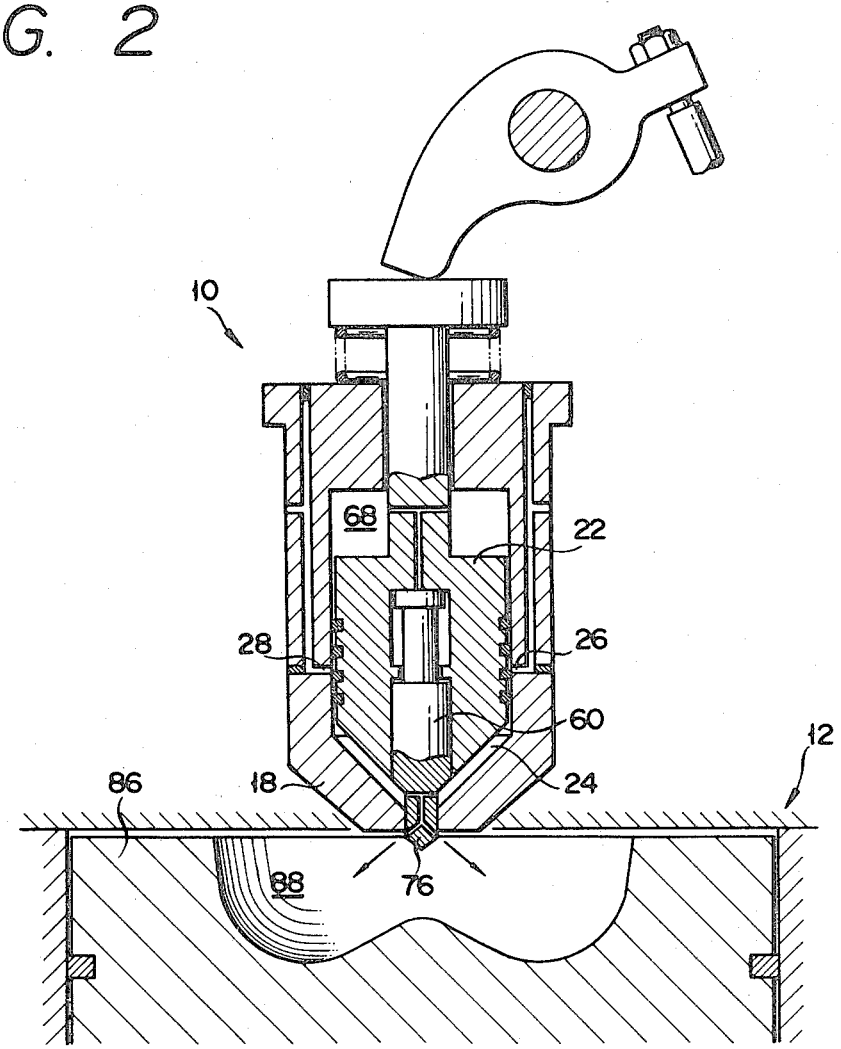
FIG. 2 is a view similar to FIG. 1 except that the nozzle assembly is shown in a state wherein the piston is fully descended together with the plunger for the injection of the premixed fuel and air into the diesel engine cylinder.

FIGS. 1 and 2 both illustrate a typical diesel fuel injection nozzle assembly in accordance with the invention, but in different phases of operation. Only FIG. 1 will be considered in describing the construction of the nozzle assembly. Generally designated 10, the representative fuel injection nozzle assembly is shown mounted in position on a diesel engine cylinder 12 and together with an actuating mechanism 14. The nozzle assembly 10 includes a nozzle body 16 in the form of an upstanding, hollow cylinder, complete with an integral nozzle tip 18 of conical shape forming its bottom.

Slidably fitted in the bore 20 in the nozzle body 16 for up-and-down reciprocation is a piston 22 pressure-tightly defining a premixing chamber 24 in combination therewith. This premixing chamber has a fuel inlet port 26 and an air inlet port 28, both formed in the nozzle body 16, which are to be covered and uncovered by the reciprocating piston 22. The fuel inlet port 26 communicates with a fuel injection pump, not shown, by way of a passage 30 in the nozzle body and a check valve 32. The air inlet port 28 communicates with a suitable source, not shown, of air under relatively low pressure (e.g., 7 kg/cm$^2$) by way of a passage 34 in the nozzle body and a check valve 36. Alternatively the air inlet port 28 may be opened to atmosphere. Both fuel inlet port 26 and air inlet port 28 are open when the piston 22 is in a first or elevated position, as depicted in FIG. 1, for admitting fuel and air into the premixing chamber 24 of maximum capacity. The piston 22 simultaneously closes the posts 26 and 28 almost immediately as it starts descending to a second position of FIG. 2, for compressing the fuel and air trapped in the premixing chamber 24.

The piston 22 is formed integral with a stem 38 of reduced diameter extending upwardly therefrom through a bore 40 in the nozzle body 16 with a sliding fit. Projecting out of the bore 40, the piston stem 38 terminates in a flange 42. A helical compression spring 44 extends between the flange 42 and the top 46 of the nozzle body 16 for normally holding the piston 22 in the elevated position in the nozzle body bore 20, with its annular shoulder 48 in abutting engagement with the top surface 50 of the bore.

The actuating mechanism 14 is per se of conventional design, including a rocker arm 52 pivoted at 54 for abutment at one end against the flange 42 of the piston stem 38. The rocker arm 52 has its other end coupled to a pushrod 56 to be moved up and down by the engine camshaft, not shown. Thus, upon upward motion of the pushrod 56, the rocker arm 52 is pivoted in a counterclockwise direction, as viewed in the figures, to depress the piston 22 within the nozzle body against the force of the compression spring 44.

Formed axially in the piston 22 is a downwardly open bore 58 in which there is slidably fitted a plunger 60 so as to project downwardly therefrom. This plunger coacts with the piston 22 to define a pressure chamber 62 for exerting a variable fluid or air pressure downwardly on the plunger. In constant communication with the pressure chamber 62 are axial 64 and radial 66 passages formed in the piston 22 and its stem 38. The radial passages 66 are open to the bore 40 in the nozzle body 16 when the piston 22 is in the elevated position, and during the descent of the piston, become open to the space 68, FIG. 2, created between the piston shoulder 48 and the opposed surface 50 of the nozzle body.

The plunger 60 has an annular recess 70 of considerable axial dimension formed adjacent its top end for extending with clearance through an annular ledge 72 on the cylindrical surface bounding the bore 58 in the piston 22. When the piston 22 is in the elevated position, the ledge 72 engages the relatively enlarged top 74 of the plunger 60 to hold same in a third or raised position as in FIG. 1.

For spraying the premixed fuel and air from the premixing chamber 24, the plunger 60 has its bottom end reduced in diameter to provide a nose 76. This nose is slidably but pressure-tightly fitted in a hole 78 formed centrally in the nozzle tip 18. Formed in the plunger nose 76 are one or more spray holes 80 in communication with the premixing chamber 24 via passages 82. The spray holes 80 are closed by the nozzle tip 18 when the plunger 60 is in the raised position, with the consequent retraction of its nose 76. Upon movement of the plunger 60 to a fourth or depressed position given in FIG. 2, its nose 76 projects out of the nozzle tip 18 for spraying the fuel-air mixture into the diesel engine cylinder 12. An annular step or shoulder 84, formed between the plunger proper and its nose, serves an important purpose of being acted upon by the compressed fuel-air mixture in the premixing chamber 24 during the downward stroke of the piston 22, as will be later explained in more detail.

The diesel engine cylinder 12 has the usual reciprocating piston 86 mounted therein to define the combustion chamber 88. The nozzle assembly 10 is to inject each charge of premixed fuel and air under pressure into this combustion chamber at the end of the compression stroke of the piston 86.

In operation, let it be assumed that the piston 22 is now raised under the bias of the compression spring 44, as in FIG. 1, holding the nose 76 of the plunger 60 retracted in the nozzle tip 18 by engaging the top 74 of the plunger with the annular ledge 72 in the bore 58. Since the piston 22 in this raised position clears both fuel inlet port 26 and air inlet port 28, fuel and air are introduced into the premixing chamber 24 from their suitable sources, to be temporarily stored therein as the nozzle tip 18 blocks the spray holes 80 in the plunger nose 76.

At or toward the end of the compression stroke of the piston 86 in the diesel engine cylinder 12, the rocker arm 52 is pivoted counterclockwise to depress the piston 22 against the force of the compression spring 44. Thus set in its downward compression stroke the piston 22 immediately closes both inlet ports 26 and 28 and, during its continued descent, compresses the fuel-air mixture trapped in the closed premixing chamber 24. The pressure chamber 62 within the piston 22 exerts a downward force on the plunger 60 during the compression stroke of the piston. However, since the fuel-air mixture being compressed in the premixing chamber 24 acts on the step 84 of the plunger 60 to apply an upward force thereto, the plunger remains substantially stationary, until at last the piston 22 moves into positive engagement with its top 74.

Thereafter the plunger 60 lowers with the piston 22 to the position of FIG. 2. The nose 76 of the lowered plunger 60 projects out of the nozzle tip 18 to place the premixing chamber 24 of minimal capacity in communication with the combustion chamber 88 of the diesel engine cylinder 12. The fuel-air mixture in the premixing chamber 24 undergoes compression, and therefore a temperature rise, from the moment of closure of the inlet ports 26 and 28 by the piston 22 to the moment of communication of the premixing chamber with the combustion chamber 88 through the passages and spray holes in the plunger nose 76. The reuslts are the thorough vaporization of the fuel and its intimate mingling with the air. Thus, as the plunger nose 76 projects out of the nozzle tip 18 at the end of the compression stroke of the piston 86, the fuel-air mixture is injected into the combustion chamber 88 in such a fine spray, under such high pressure, and at such high temperature that the fuel is ignited immediately by the high temperature air therein.

Although the diesel fuel injection nozzle assembly according to this invention has been disclosed in terms of one preferred form thereof, it is to be understood that the invention itself is not to be limited thereby but only by the scope of the appended claims.

What we claim is:

1. A nozzle assembly for the injection of premixed fuel and air into a diesel engine cylinder, comprising:

(a) a nozzle body;

(b) a piston reciprocably mounted in the nozzle body and defining a premixing chamber in combination therewith, the premixing chamber having a fuel inlet port and an air inlet port which are opened by the piston when the latter is in a first position, where the capacity of the premixing chamber is maximized, and which are closed by the piston upon its movement toward a second position where the capacity of the premixing chamber is reduced to a minimum, so that the piston compresses the fuel-air mixture trapped in the premixing chamber on its stroke from the first to the second position;

(c) a plunger also mounted in the nozzle body for reciprocation between a third and a fourth position, the plunger having a spray hole formed in one end which is retracted in the nozzle body for closing the premixing chamber against the diesel engine cylinder when the plunger is in the third position and which projects out of the nozzle body for spraying the compressed fuel-air mixture into the diesel engine cylinder from the premixing chamber when the plunger is in the fourth position, the plunger being operatively engaged with the piston in such a way that the piston when in the first position holds the plunger in the third position and moves the plunger to the fourth position only toward the end of its stroke from the first to the second position.

2. The nozzle assembly of claim 1, wherein the plunger is slidably received in a bore in the piston and defines therein a pressure chamber adapted to exert on the plunger a variable fluid pressure tending to move same from the third to the fourth position during the travel of the piston from the first to the second position, and wherein the plunger has a step situated in the premixing chamber so that the fuel-air mixture being compressed therein by the piston acts on the step of the plunger to hold same in the third position against the fluid pressure in the pressure chamber, until the piston forces the plunger to the fourth position toward the end of its stroke from the first to the second position.

3. The nozzle assembly of claim 2, wherein the bore in the piston has a ledge in engagement with the plunger for holding same in the third position when the piston is in the first position.

4. The nozzle assembly of claim 1, further comprising resilient means for normally holding the piston in the first position.

5. A nozzle assembly for the injection of premixed fuel and air into a diesel engine cylinder, comprising:

(a) a nozzle body having a bore formed therein;

(b) a bored piston reciprocably mounted in the bore in the nozzle body and defining a premixing chamber therein, the premixing chamber having a fuel inlet port and an air inlet port, for the admission of fuel and air, which are both covered and uncovered by the piston;

(c) a plunger having one end slidably engaged in the bore in the piston to define a pressure chamber therein and having the other end arranged for movement out of and back into the nozzle body, the pressure chamber being adapted to exert, during the stroke of the piston in a direction to compress the fuel and air admitted into the premixing chamber, a variable fluid pressure on the plunger for urging same in such a direction as to cause the movement of said other end thereof out of the nozzle body;

(d) there being spray hole in said other end of the plunger for spraying the compressed fuel-air mixture into the diesel engine cylinder from the premixing chamber upon movement of said other end of the plunger out of the nozzle body; and (e) a step formed on the plunger and situated in the premixing chamber so that the fuel-air mixture being compressed therein by the piston acts on the step of the plunger for holding said other end thereof retracted against the fluid pressure in the pressure chamber, until the piston moves into positive engagement with the plunger for moving said other end thereof out of the nozzle body.

* * * * *